US009785092B1

(12) United States Patent
Sakata

(10) Patent No.: US 9,785,092 B1
(45) Date of Patent: Oct. 10, 2017

(54) DEVELOPING CARTRIDGE PROVIDED WITH DEVELOPING ROLLER, GEAR COVER, AND ELECTRIC CONTACT

(71) Applicant: Brother Kogyo Kabushiki Kaisha, Nagoya-shi, Aichi-ken (JP)

(72) Inventor: Isamu Sakata, Obu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/275,595

(22) Filed: Sep. 26, 2016

(30) Foreign Application Priority Data

Mar. 15, 2016 (JP) ..... 2016-051389

(51) Int. Cl.
*G03G 15/08* (2006.01)
*G03G 21/16* (2006.01)
*G03G 15/00* (2006.01)

(52) U.S. Cl.
CPC ..... *G03G 15/0889* (2013.01); *G03G 15/80* (2013.01); *G03G 21/1647* (2013.01)

(58) Field of Classification Search
CPC ..... G03G 15/0889; G03G 15/80; G03G 21/1647; G03G 21/1676; G03G 2221/163
USPC ..... 399/90, 119, 120
See application file for complete search history.

(56) References Cited

U.S. PATENT DOCUMENTS 8,774,671 B2 * 7/2014 Okabe ..... G03G 21/1676 399/90 X
9,195,207 B2 11/2015 Itabashi
2013/0051815 A1 2/2013 Itabashi et al.
2013/0051816 A1 2/2013 Itabashi
2013/0058675 A1 3/2013 Anan et al.
2015/0125176 A1 5/2015 Fujii et al.
2016/0054702 A1 2/2016 Itabashi

FOREIGN PATENT DOCUMENTS

JP 2004-109189 A 4/2004
JP 2007-058057 A 3/2007
JP 2013-054053 A 3/2013
JP 2013-054062 A 3/2013
JP 2013-054216 A 3/2013
JP 2014016483 A 1/2014
JP 2016-054062 A 4/2016

OTHER PUBLICATIONS

Dec. 13, 2016—(WO) International Search Report and Written Opinion—App PCT/JP2016/078177.
English Translation of Dec. 13, 2016—(WO) International Search Report and Written Opinion—App PCT/JP2016/078177.

* cited by examiner

*Primary Examiner* — Sophia S Chen
(74) *Attorney, Agent, or Firm* — Banner & Witcoff, Ltd.

(57) ABSTRACT

A developing cartridge includes a developing roller, a shaft, a gear, an electric contact, and a gear cover. The developing roller is rotatable about a first axis extending in a predetermined direction and includes a developing roller shaft extending along the first axis. The shaft extends in the predetermined direction and has a peripheral surface. The gear is rotatable about the shaft. The electric contact is positioned at the peripheral surface of the shaft. The gear cover covers at least a portion of the gear and electrically connects the electric contact and the developing roller shaft.

15 Claims, 8 Drawing Sheets

DEVELOPING CARTRIDGE PROVIDED WITH DEVELOPING ROLLER, GEAR COVER, AND ELECTRIC CONTACT

CROSS REFERENCE TO RELATED APPLICATION

This application claims priority from Japanese Patent Application No. 2016-051389 filed Mar. 15, 2016. The entire content of the priority application is incorporated herein by reference.

TECHNICAL FIELD

The present disclosure relates to a developing cartridge.

BACKGROUND

A developing cartridge includes a developing roller, and a casing in which a toner is accommodated. The developing cartridge is attachable to and detachable from an image forming apparatus.

Prior art discloses a developing cartridge provided with a developing electrode which is electrically connected to a shaft of the developing roller. More specifically, the developing electrode includes a sleeve portion and a bearing portion. An electrode of the image forming apparatus can contact with the sleeve portion. The shaft of the developing roller is inserted into the bearing portion. The developing cartridge further includes a gear rotatable about the sleeve portion and a protrusion rotatable together with the gear.

SUMMARY

In the disclosed developing cartridge, there may be a situation that insertion of the shaft of the developing roller into the bearing portion of the electrode is undesirable.

It is therefore an object of the disclosure to provide a developing cartridge capable of supplying electric power to the shaft of the developing roller by making use of a gear cover.

This and other object will be attained by providing a developing cartridge including a developing roller, a shaft, a gear, an electric contact, and a gear cover. The developing roller is rotatable about a first axis extending in a predetermined direction and includes a developing roller shaft extending along the first axis. The shaft extends in the predetermined direction and has a peripheral surface. The gear is rotatable about the shaft. The electric contact is positioned at the peripheral surface of the shaft. The gear cover covers at least a portion of the gear and electrically connects the electric contact and the developing roller shaft.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
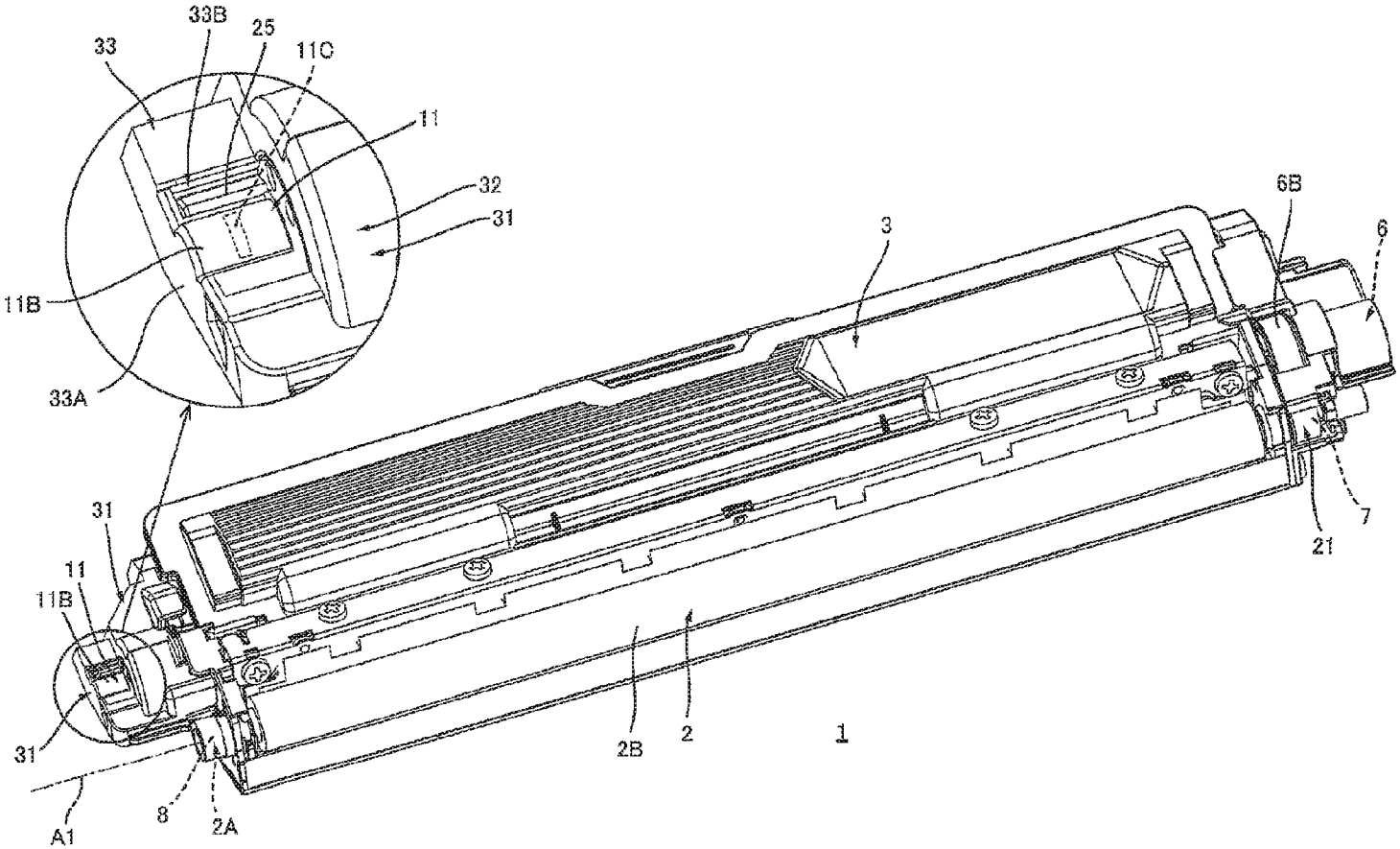
FIG. 1 is a perspective view of a developing cartridge according to a first embodiment.

A developing cartridge according to a first embodiment will be described with reference to FIGS. 1 through 4B.

1. Overview of Developing Cartridge

The developing cartridge 1 includes a developing roller 2 and a casing 3.

1.1 Developing Roller 2

The developing roller 2 extends in a predetermined direction. The developing roller 2 is rotatable about a first axis A1 extending in the predetermined direction. The first axis A1 may be coincident with a central axis of the developing roller 2. The developing roller 2 includes a shaft part 2A and roller part 2B. The shaft part 2A extends along the first axis A1. The roller part 2B has a cylindrical shape extending in the predetermined direction. The roller part 2B is rotatable along with the shaft part 2A. The shaft part 2A is an example of the developing roller shaft.

The shaft part 2A includes a first protruding portion 7 and second protruding portion 8. The first protruding portion 7 protrudes from one end portion of the roller part 2B in the predetermined direction. The second protruding portion 8 protrudes from the other end portion of the roller part 2B in the predetermined direction. The second protruding portion 8 is positioned opposite to the first protruding portion 7 with respect to the roller part 2B in the predetermined direction. The shaft part 2A is made from metal such as a stainless steel and iron.

The shaft part 2A may extend through the roller part 2B in the predetermined direction. Alternatively, the shaft part 2A may not extend through the roller part 2B. Further alternatively, the shaft part 2A may include a first shaft extending from the one end portion of the roller part 2B, and a second shaft extending from the other end portion of the roller part 2B.

1.2 Casing 3

The casing 3 extends in the predetermined direction. A developing agent can be accommodated in the casing 3. Powdered toner is an example of the developing agent. The casing 3 is a hollow tubular member having a polygonal cross-section, and is made from an insulating resin. In the following description, "insulation properties" implies electrically insulating properties capable of electrically insulating developing bias voltage. Further, in the following description, "inner side" of the casing 3 implies a side in which the developing agent is accommodated, and the "outer side" of the casing 3 implies a side opposite to the inner side. Further, "inner surface" implies a surface at the inner side of the casing 3, and "outer surface" implies a surface at the outer side of the casing 3.

1.3 Agitator

The developing cartridge 1 further includes an agitator.

An agitator is provided at the inner side of the casing 3. The agitator is rotatable about a second axis A2 extending in the predetermined direction. More specifically, the agitator includes an agitator shaft 4 illustrated in FIG. 2 and fins (not shown). The agitator shaft 4 is spaced away from the shaft part 2A in a radial direction of a shaft 11. The agitator shaft 4 extends along the second axis A2. The fins are rotatable about the second axis A2 together with the agitator shaft 4. By the rotation of the fins within the casing 3, toner in the casing 3 can be agitated.

1.4 Coupling 6

Figure 3:
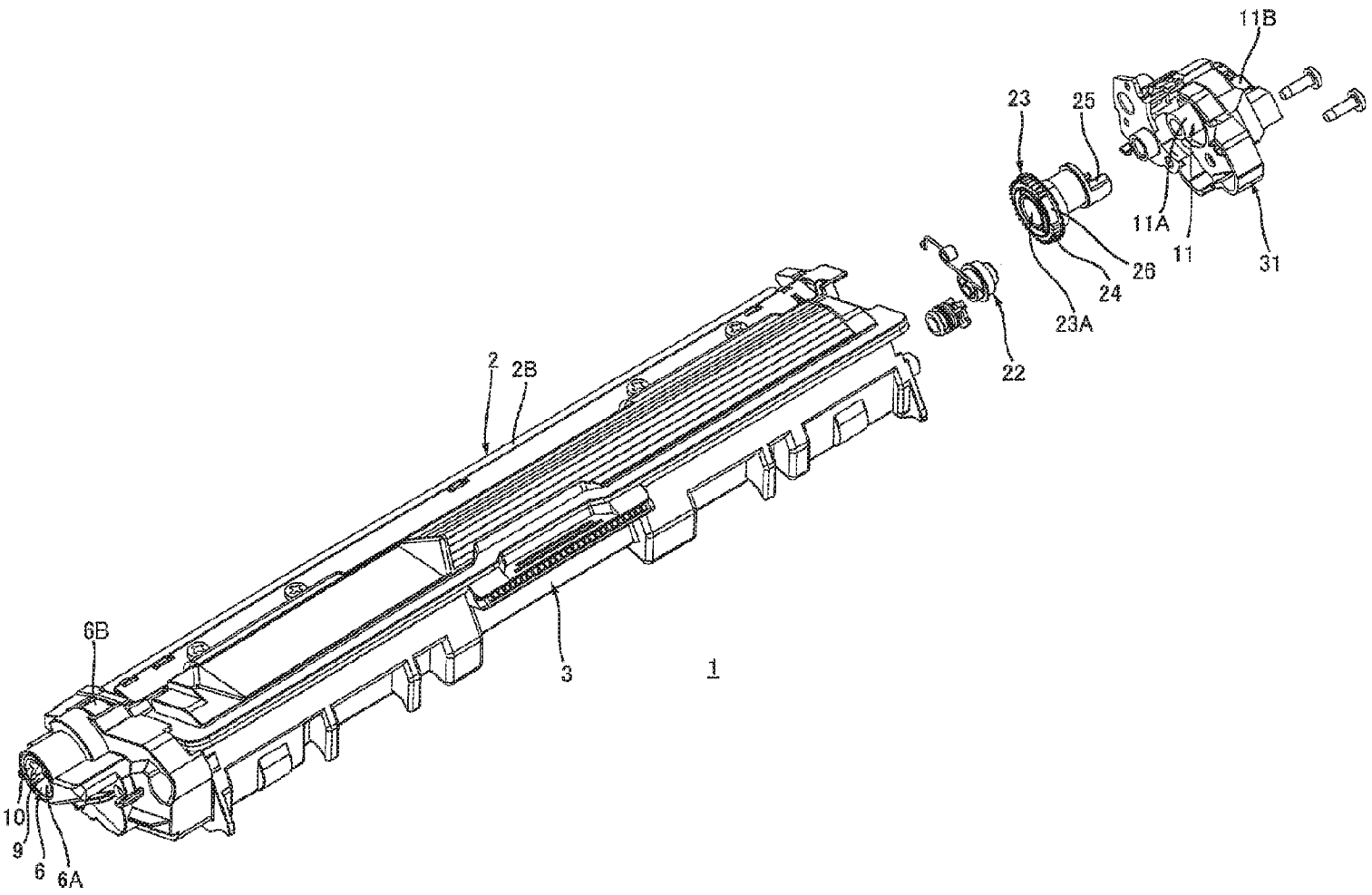
FIG. 3 is an exploded perspective view of the developing cartridge illustrated in FIG. 1 as viewed in a direction opposite to a direction of FIG. 2.

As illustrated in FIG. 3, the developing cartridge 1 further includes a coupling 6 positioned at one outer surface of the casing 3 in the predetermined direction. The coupling 6 is rotatable about an axis extending in the predetermined direction. The coupling 6 includes a joint 6A, and a coupling gear 6B.

The joint 6A is configured to receive driving force from an outside of the developing cartridge 1. The joint 6A is positioned at one end portion of the coupling 6 in the predetermined direction. The joint 6A is positioned opposite to the casing 3 with respect to the coupling gear 6B. The joint 6A has a cylindrical shape extending in the predetermined direction. The joint 6A includes a recessed portion 9 and an engaging portion 10. The recessed portion 9 is positioned at an outer surface of the joint 6A in the predetermined direction, and is recessed toward the other end portion of the coupling 6 in the predetermined direction. The engaging portion 10 is positioned within the recessed portion 9, and is configured to be engaged with a driving force input portion (not shown) of an image forming apparatus. Upon engagement between the engaging portion 10 and the driving force input portion, the coupling 6 receives driving force from the driving force input portion.

The coupling gear 6B is positioned between the joint 6A and the casing 3 in the predetermined direction, and is rotatable together with the joint 6A. The coupling gear 6B has a peripheral surface provided with a plurality of gear teeth.

2. Shaft 11 and Electric Contact 11C

Figure 2:
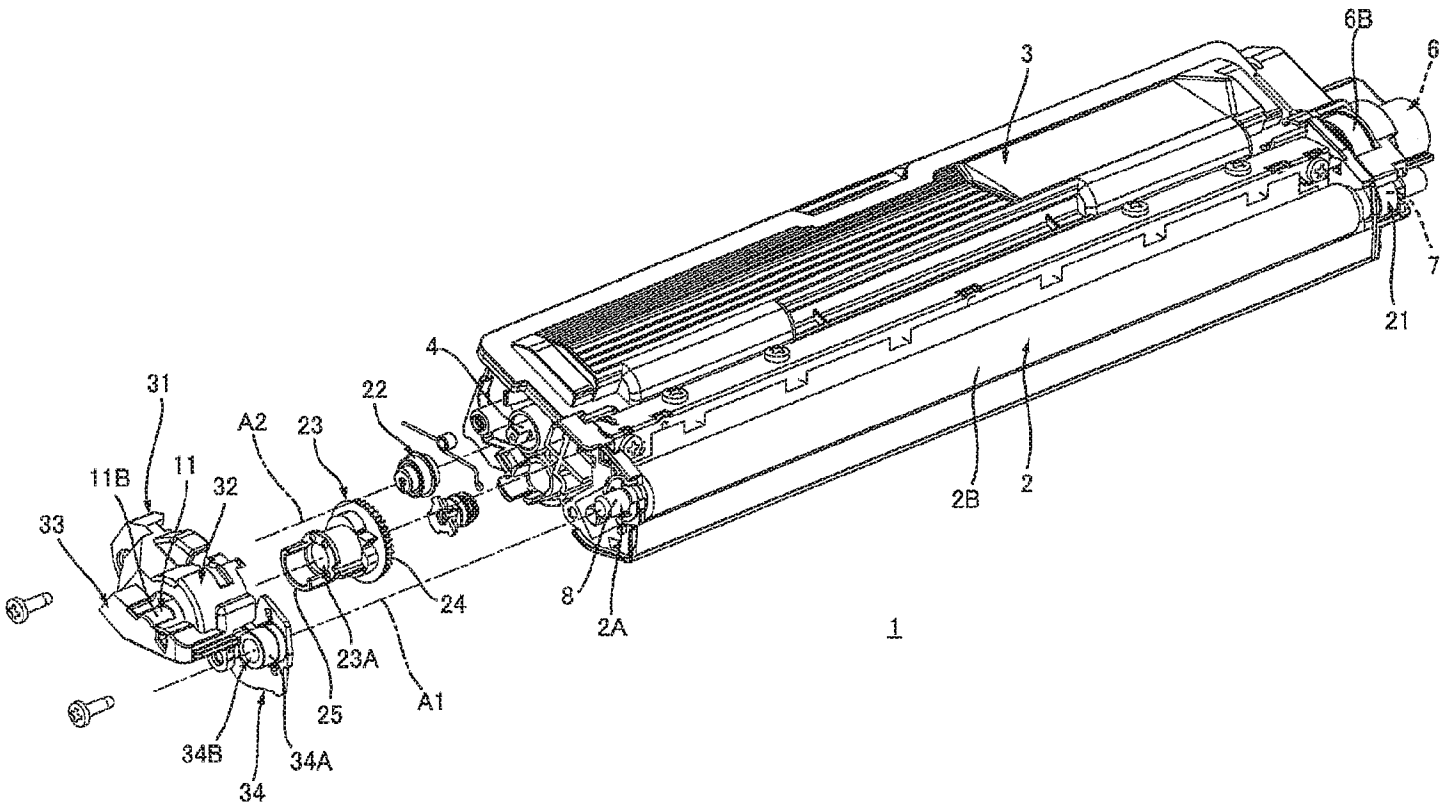
FIG. 2 is an exploded perspective view of the developing cartridge illustrated in FIG. 1.

As illustrated in FIGS. 1 and 2, the developing cartridge 1 further includes the shaft 11.

2.1 Shaft 11

The shaft 11 is positioned opposite to the coupling 6 with respect to the casing 3 in the predetermined direction. Further, the shaft 11 is positioned opposite to a developing gear 21 (described later) with respect to the casing 3 in the predetermined direction. The shaft 11 extends in the predetermined direction, and is provided integrally with a gear cover 31 (described later). The shaft 11 is positioned at the outer surface of the casing 3 in the predetermined direction after the gear cover 31 is attached to the casing 3. In the attachment state of the gear cover 31 to the casing 3, the shaft 11 is positioned closer to the shaft part 2A than the agitator shaft 4 to the shaft part 2A in the radial direction of the shaft 11.

As illustrated in FIGS. 2 and 3, the shaft 11 includes one end portion 11A and the other end portion 11B in the predetermined direction. The other end portion 11B is positioned farther from the outer surface of the casing 3 than the one end portion 11A from the outer surface in the predetermined direction. The shaft 11 is made from an electrically conductive resin. In the following description, the terms "electrically conductive" implies electrical conductivity capable of supplying developing bias voltage to the shaft part 2A. Polyacetal resin (Polyoxymethylene or POM) is one of examples of the electrically conductive resin.

2.2 Electrical Contact 11C

As illustrated in FIG. 1, the shaft 11 includes an electric contact 11C.

The electric contact 11C is a portion of the shaft 11, and is configured to contact an electrode of the image forming apparatus. The electric contact 11C is positioned at a peripheral surface of the other end portion 11B of the shaft 11.

3. Developing Gear 21, Agitator Gear 22 and Detection Gear 23

As illustrated in FIG. 2, the developing cartridge 1 includes the developing gear 21, an agitator gear 22, and a detection gear 23. The detection gear 23 is an example of the gear.

3.1 Developing Gear 21

The developing gear 21 is positioned at the one outer surface of the casing 3 in the predetermined direction, and further, the developing gear 21 and the coupling 6 are positioned at a same side of the casing 3 in the predetermined direction. The developing gear 21 is in meshing engagement with the coupling gear 6B. The developing gear 21 is mounted to the first protruding portion 7 of the shaft part 2A, so that the developing gear 21 is rotatable together with the shaft part 2A. The developing gear 21 includes a peripheral surface provided with a plurality of gear teeth.

3.2 Agitator Gear 22

The agitator gear 22 is positioned at the other outer surface of the casing 3 in the predetermined direction. The agitator gear 22 is positioned opposite to the coupling 6 with respect to the casing 3 in the predetermined direction. Further, the agitator gear 22 is positioned opposite to the developing gear 21 with respect to the casing 3 in the predetermined direction. The agitator shaft 4 includes one end portion and the other end portion in the predetermined direction. The agitator gear 22 is mounted to the other end portion of the agitator shaft 4, so that the agitator gear 22 is mounted to the agitator. The agitator gear 22 is rotatable together with the agitator shaft 4. That is, the agitator gear 22 is rotatable along with the agitator. The agitator gear 22 includes a peripheral surface provided with a plurality of gear teeth.

A gear (not shown) is mounted to the one end portion of the agitator shaft 4, and is rotatable together with the agitator shaft 4. The gear (not shown) is configured to receive driving force from the coupling gear 6B, thereby rotating the agitator.

3.3 Detection Gear 23

As illustrated in FIGS. 2 and 3, the detection gear 23 is positioned opposite to the coupling 6 with respect to the casing 3 in the predetermined direction. Further, the detection gear 23 is positioned opposite to the developing gear 21 with respect to the casing 3 in the predetermined direction. The detection gear 23 and the agitator gear 22 are positioned at a same side of the casing 3 in the predetermined direction. The detection gear 23 is positioned at the other outer surface of the casing 3 in the predetermined direction. The detection gear 23 is made from an electrically insulating resin. The detection gear 23 extends in the predetermined direction, and includes one end portion and the other end portion in the predetermined direction. The other end portion is positioned farther from the outer surface of the casing 3 than the one end portion from the outer surface of the casing 3 in the predetermined direction. The detection gear 23 has an insertion hole 23A extending in the predetermined direction. The hole 23A penetrates the detection gear 23 in the predetermined direction. The shaft 11 is inserted into the insertion hole 23A, so that the detection gear 23 is rotatable about the shaft 11. The detection gear 23 includes a plurality of gear teeth 24 and a protrusion 25.

The plurality of gear teeth 24 are positioned at the one end portion of the detection gear 23. The plurality of gear teeth 24 are arranged in a rotational direction of the detection gear 23 with such a gear pitch that the gear teeth 24 can be in meshing engagement with the gear teeth of the agitator gear 22. At least one of the plurality of gear teeth 24 can be meshingly engaged with the agitator gear 22. The plurality of gear teeth 24 are arranged at a portion of a peripheral surface of the detection gear 23. In other words, the detection gear 23 includes a teeth-lacking portion 26, which is aligned with the gear teeth 24 in the rotational direction. The teeth-lacking portion 26 has a length in the rotational direction capable of releasing meshing engagement between the plurality of gear teeth 24 and the agitator gear 22.

The protrusion 25 positioned at the other end portion of the detection gear 23. The protrusion 25 is provided at a portion of the detection gear 23 in the rotational direction of the detection gear 23. The protrusion 25 extends in the predetermined direction. Further, the protrusion 25 extends in the rotational direction of the detection gear 23. The protrusion 25 is positioned around the insertion hole 23A. The protrusion 25 is integral with the detection gear 23. More specifically, the protrusion 25 is integral with the plurality of gear teeth 24. Accordingly, the protrusion 25 is rotatable together with the detection gear 23.

4. Gear Cover 31

The developing cartridge 1 further includes the gear cover 31. The gear cover 31 is positioned opposite to the coupling 6 with respect to the casing 3 in the predetermined direction. Further, the gear cover 31 is positioned opposite to the developing gear 21 with respect to the casing 3 in the predetermined direction. The gear cover 31 is positioned at the other outer surface of the casing 3 in the predetermined direction. The gear cover 31 is made from an electrically conductive resin, and is integral with the shaft 11.

4.1 Structure of Gear Cover 31

Figure 4A:
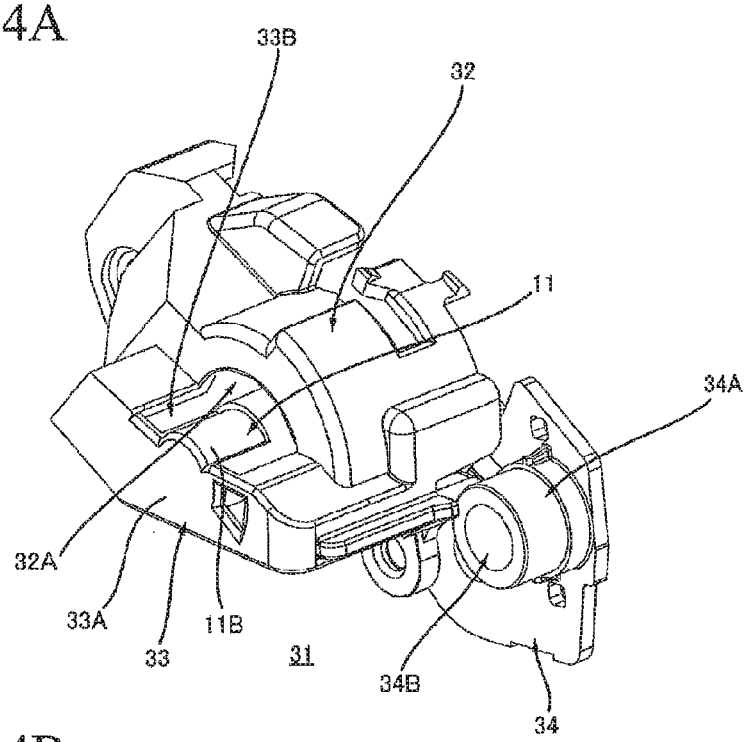
FIG. 4A is a perspective view of a gear cover of the developing cartridge as viewed in the direction of FIG. 2.
Figure 4B:
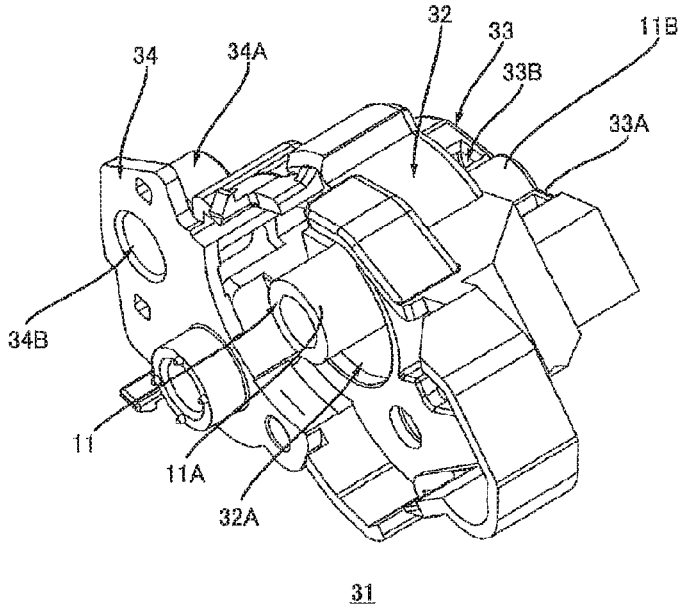
FIG. 4B is a perspective view of the gear cover of the developing cartridge as viewed in the direction of FIG. 3.

As illustrated in FIGS. 4A and 4B, the gear cover 31 includes a main body portion 32, an end cover 33, and a bearing portion 34.

The main body portion 32 is configured to cover at least a portion of the plurality of gear teeth 24 of the detection gear 23. That is, the gear cover 31 covers at least a portion of the detection gear 23. The main body portion 32 extends in the predetermined direction. The main body portion 32 has an insertion hole 32A. The insertion hole 32A penetrates the main body portion 32 in the predetermined direction. That is, the insertion hole 32A is defined by an inner peripheral surface of the main body portion 32. The shaft 11 is positioned in the insertion hole 32A. The peripheral surface of the shaft 11 and the inner peripheral surface of the main body portion 32 are spaced away from each other in the radial direction of the shaft 11. The insertion hole 32A has an inner peripheral surface spaced away from the peripheral surface of the shaft 11. The detection gear 23 is inserted into the insertion hole 32A. More specifically, the protrusion 25 is inserted into the insertion hole 32A.

The end cover 33 is positioned opposite to the casing 3 with respect to the main body portion 32 in the predetermined direction. The end cover 33 extends in the predetermined direction, and includes one end portion and the other end portion in the predetermined direction. The end cover 33 protrudes from the main body portion 32 in the predetermined direction. The end cover 33 includes a distal end portion 33A and an opening 33B.

The distal end portion 33A is positioned at the other end portion of the end cover 33 in the predetermined direction. The distal end portion 33A is continuous to the other end portion 11B of the shaft 11. In other words, the distal end portion 33A is integral with the other end portion 11B of the shaft 11.

The opening 33B is positioned between the main body portion 32 and the distal end portion 33A in the predetermined direction. The opening 33B is in communication with the insertion hole 32A in the predetermined direction. The opening 33B penetrates the end cover 33 in the radial direction of the shaft 11. The other end portion 11B of the shaft 11 is positioned at the opening 33B and is exposed to an outside through the opening 33B. Further, as illustrated in FIG. 1, the protrusion 25 of the detection gear 23 is at a position radially outward of the other end portion 11B, and the protrusion 25 can be exposed to the outside through the opening 33B.

As illustrated in FIGS. 4A and 4B, the bearing portion 34 extends from the main body portion 32 in a direction perpendicular to the predetermined direction. The bearing portion 34 is positioned closer to the shaft part 2A than the main body portion 32 to the shaft part 2A in the radial direction of the shaft 11. The bearing portion 34 includes a collar 34A. The collar 34A extends in the predetermined direction and has an insertion hole 34B. The insertion hole 34B extends through a length of the collar 34A in the predetermined direction. The second protruding portion 8 of the shaft part 2A is inserted into the insertion hole 34B, such that an inner peripheral surface of the collar 34A is in contact with a peripheral surface of the second protruding portion 8.

4.2 Electrical Connection Between Electric Contact 11C and Shaft Part 2A of Developing Roller As described above, the shaft 11 and the gear cover 31 are made from the electrically conductive resin. The shaft 11 is integral with the gear cover 31 because the other end portion 11B of the shaft 11 is continuous to the distal end portion 33A.

As illustrated in FIG. 2, the bearing portion 34 of the gear cover 31 is in contact with the second protruding portion 8 of the shaft part 2A.

With this structure, the electric contact 11C of the shaft 11 is electrically connected to the second protruding portion 8 of the shaft part 2A through the distal end portion 33A and the bearing portion 34 of the gear cover 31.

5. Determination as to Whether the Developing Cartridge 1 is New or Old

Determination as to whether the developing cartridge 1 is new or used will be described with reference to FIGS. 1 and 2.

Upon assembly of the developing cartridge 1 to the image forming apparatus, an electrode of the image forming apparatus is in contact with the electric contact 11C. Thus, developing bias voltage is supplied to the second protruding portion 8 of the shaft part 2A from the electric contact 11C through the distal end portion 33A and the bearing portion 34 of the gear cover 31.

Further, upon assembly of the developing cartridge 1 to the image forming apparatus, driving force is inputted to the coupling 6 from the driving force input portion of the image forming apparatus. As a result, the driving force is transmitted to the agitator shaft 4 from the coupling 6 through the gear (not shown) to rotate the agitator, which causes rotation of the agitator gear 22 along with the agitator shaft 4.

Upon the rotation of the agitator 22, the detection gear 23 receives driving force from the agitator gear 22, so that the detection gear 23 is rotated.

The protrusion 25 is rotated in accordance with the rotation of the detection gear 23, so that the protrusion 25 is moved along the peripheral surface of the shaft 11.

By the movement of the protrusion 25, the protrusion 25 is moved through a space between the electric contact 11C and the electrode of the image forming apparatus. In this instance, the electrode of the image forming apparatus is separated from the electric contact 11C because the protrusion 25 is positioned between the electrode of the image forming apparatus and the electric contact 11C.

Accordingly, electrical connection between the electrode of the image forming apparatus and the electric contact 11C is shut off or interrupted, and supply of developing bias voltage to the shaft part 2A is stopped.

When the protrusion 25 is moved past the space between the electrode of the image forming apparatus and the electric contact 11C, the electrode of the image forming apparatus is again in contact with the electric contact 11C. Thus, the developing bias voltage is again supplied from the electric contact 11C to the second protruding portion 8 of the shaft part 2A through the distal end portion 33A and bearing portion 34 of the gear cover 31.

Then, meshing engagement between the plurality of gear teeth 24 of the detection gear 23 and the agitator gear 22 is released when the teeth-lacking portion 26 (FIG. 3) faces the agitator gear 22. Thus, rotation of the detection gear 23 is stopped.

In this way, the electrode of the image forming apparatus is first positioned at a contact position where the electrode is in contact with the shaft 11, and then moves a separated position where the electrode is separated from the shaft 11, and then returns to the contact position. These changes occur within a predetermined period of time after the developing cartridge 1 is attached to the image forming apparatus. Thus, the image forming apparatus determines that the attached developing cartridge is a new developing cartridge as a result of sequential detection of the contact position, the separated position, and contact position within the predetermined period of time.

Incidentally, the image forming apparatus determines that the attached cartridge is a used developing cartridge in such a case where the contact position is maintained for a predetermined period of time after the developing cartridge 1 is attached to the image forming apparatus.

6. Function and Effect

As described above and illustrated in FIGS. 4A and 4B, in the developing cartridge 1, the shaft 11 is continuous to the distal end portion 33A, that is, the shaft 11 is integral with the distal end portion 33A of the gear cover 31. Further, the gear cover 31 covers the detection gear 23, and the shaft 11 and the gear cover 31 are made from the electrically conductive resin.

Further, as illustrated in FIGS. 1 and 2, the bearing portion 34 of the gear cover 31 is in contact with the second protruding portion 8 of the shaft part 2A.

With this structure, the shaft 11 is electrically connected to the second protruding portion 8 of the shaft part 2A through the distal end portion 33A and the bearing portion 34 of the gear cover 31.

As a result, electric power supplied to the electric contact 11C of the shaft 11 can be supplied to the shaft part 2A by making use of the gear cover 31.

7. Second Embodiment

Figure 5:
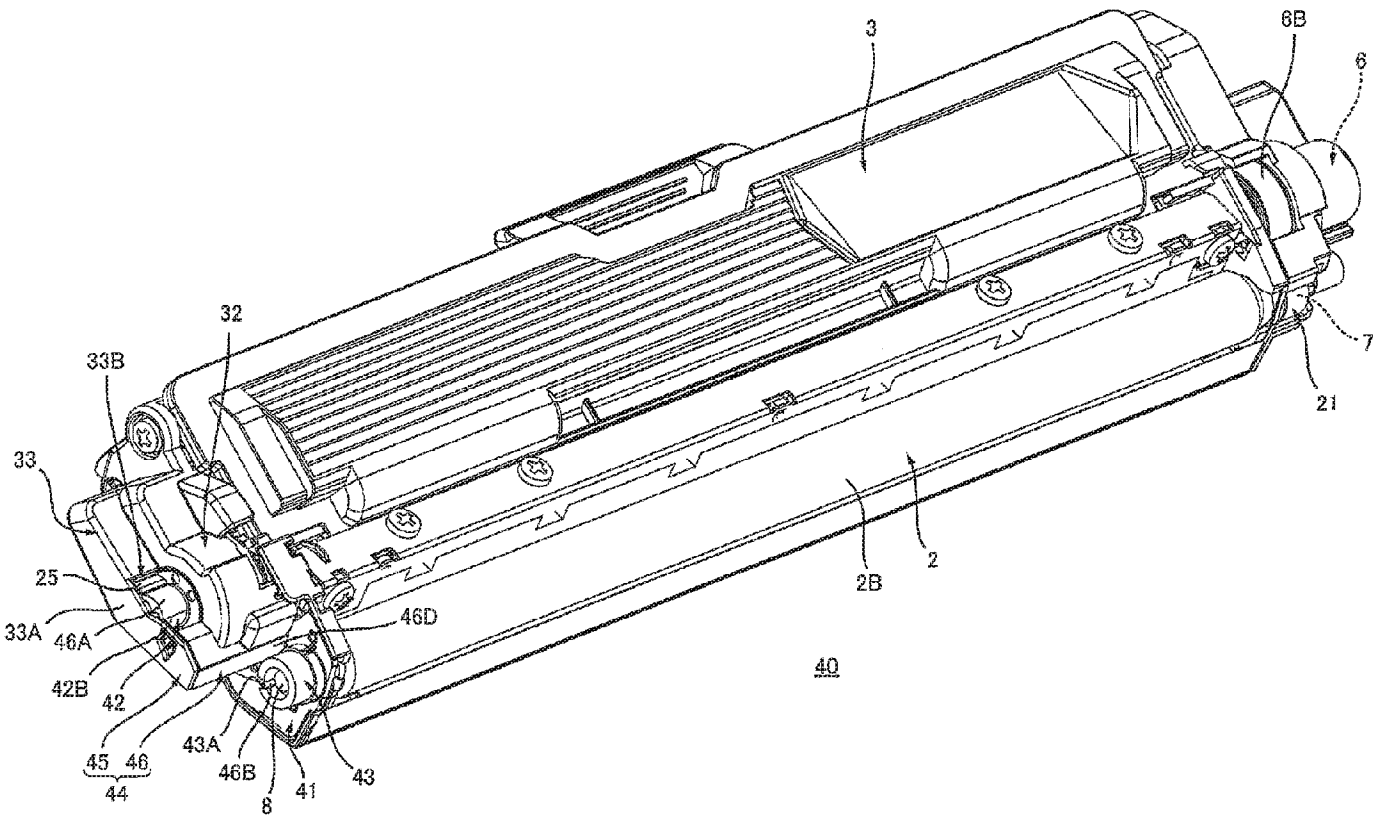
FIG. 5 is a perspective view of a developing cartridge according to a second embodiment.
Figure 6:
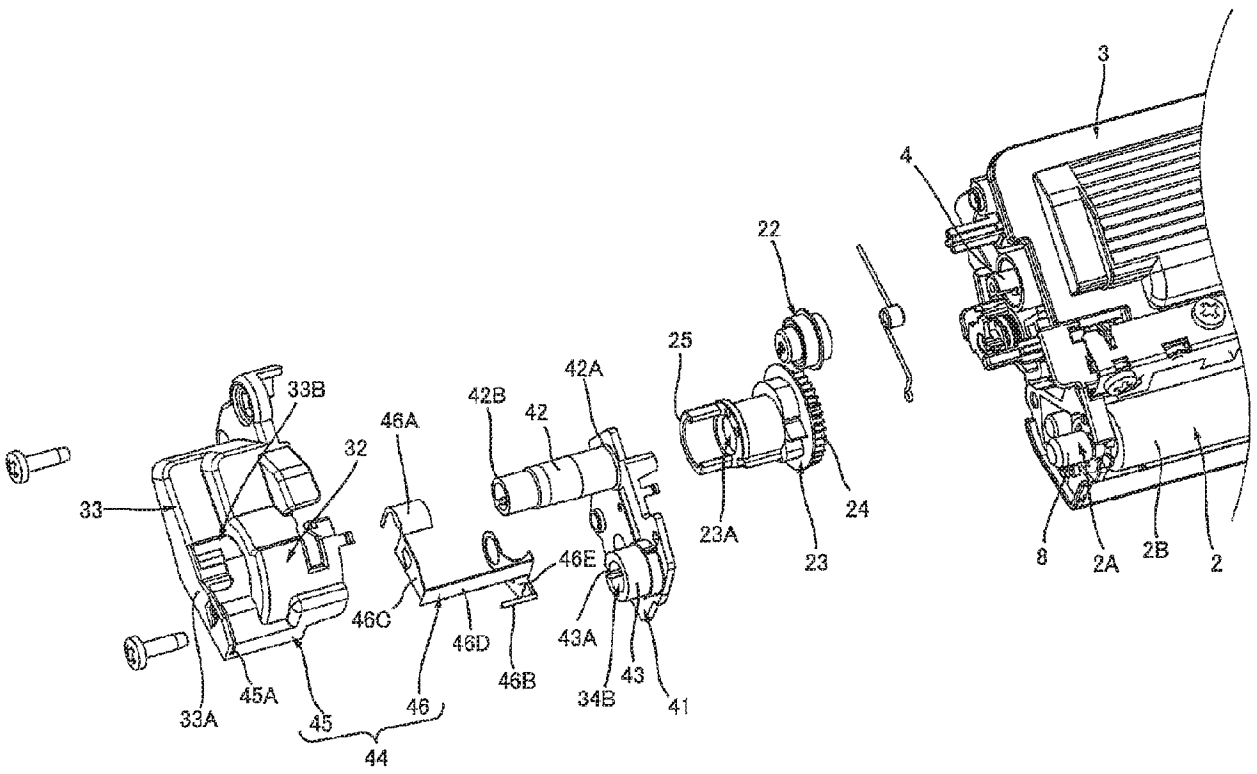
FIG. 6 is an exploded perspective view of the developing cartridge illustrated in FIG. 5.

A developing cartridge 40 according to a second embodiment will be described with reference to FIGS. 5 and 6, wherein like parts and components are designated by the same reference numerals as those shown in the first embodiment to eliminate duplicating description.

7.1 Overview of Developing Cartridge 40

The developing cartridge 40 includes a bearing portion 41. A shaft 42 is provided integrally with the bearing portion 41. The bearing portion 41 and the shaft 42 are made from an electrically insulating resin.

7.2 Bearing 41

The bearing portion 41 is positioned opposite to the coupling 6 with respect to the casing 3 in the predetermined direction. Further, the bearing portion 41 is positioned opposite to the developing gear 21 with respect to the casing 3 in the predetermined direction. The bearing portion 41 includes a collar 43.

The collar 43 is the same as the collar 34A in the first embodiment except that the collar 43 has a slot 43A. Preferably, the slot 43A is formed in the collar 43. The second protruding portion 8 of the shaft part 2A is inserted into the collar 43. The slot 43A is positioned between the shaft part 2A and the shaft 42 in a radial direction of the shaft 42. The slot 43A penetrates the collar 43 in a radial direction thereof, and extends in the predetermined direction.

7.3 Shaft 42

The shaft 42 extends in the predetermined direction, and includes one end portion 42A continuous to the bearing portion 41. That is, the one end portion 42A is integral with the bearing portion 41. The shaft 42 includes the other end portion 42B positioned farther from the outer surface of the casing 3 than the one end portion 42A to the outer surface. The shaft 42 is provided separately from a gear cover 44 (described later). The other end portion 42B is mounted to a distal end portion 33A of the gear cover 44.

7.4 Gear Cover 44

The gear cover 44 includes a cover member 45 and an electrically conductive member 46.

7.4.1 Cover Member 45

The cover member 45 is positioned opposite to the casing 3 with respect to the bearing portion 41 in the predetermined direction, and is made from an electrically insulating resin. The cover member 45 is almost the same as the gear cover 31 of the first embodiment except that the cover member 45 does not include the bearing portion 34 and the shaft 11, but the cover member 45 has a groove 45A.

The groove 45A is positioned closer to the shaft part 2A than the opening 33B to the shaft part 2A in a radial direction of the shaft 42. The groove 45A extends in the radial direction of the shaft 42. The groove 45A extends along an inner surface of the distal end portion 33A.

7.4.2 Electrically Conductive Member 46

The electrically conductive member 46 is positioned between the distal end portion 33A of the cover member 45 and the bearing portion 41 in the predetermined direction. The electrically conductive member 46 is supported to the cover member 45, and is a metal plate. The electrically conductive member 46 includes a first end portion 46A, a second end portion 46B, a first plate 46C, a second plate 46D, and a third plate 46E.

The first end portion 46A is positioned at the outer peripheral surface of the other end portion 42B of the shaft 42. The first end portion 46A is arcuate in shape curved along the outer peripheral surface of the other end portion 42B. The first end portion 46A is exposed to the outside through the opening 33B of the cover member 45. The first end portion 46A has an electric contact to be in contact with the electrode of the image forming apparatus when the developing cartridge 40 is attached to the image forming apparatus.

The second end portion 46B is positioned in the slot 43A of the bearing portion 41, and is in contact with the second protruding portion 8 of the shaft part 2A. Therefore, the electrically conductive member 46 is electrically connected to the shaft part 2A.

The first plate 46C faces the distal end portion 33A in the predetermined direction. The first plate 46C is positioned closer to the shaft part 2A than the first end portion 46A to the shaft part 2A in the radial direction of the shaft 42. The first plate 46C extends in the radial direction of the shaft 42, and has one end portion and the other end portion in the radial direction. The one end portion of the first plate 46C is continuous to the first end portion 46A. The other end portion of the first plate 46C is positioned closer to the shaft part 2A than the one end portion of the first plate 46C to the shaft part 2A in the radial direction of the shaft 42. The first plate 46C extends along the end cover 33 of the cover member 45 and is fitted in the groove 45A of the cover member 45.

The second plate 46D extends in the predetermined direction, and includes one end portion and the other end portion in the predetermined direction. The one end portion of the second plate 46D is continuous to the other end portion of the first plate 46C. The other end portion of the second plate 46D is positioned closer to the bearing portion 41 than the one end portion of the second plate 46D to the bearing portion 41 in the predetermined direction. The second plate 46D is positioned between the shaft 42 and the shaft part 2A in the radial direction of the shaft 42. The second plate 46D faces an outer surface of the cover member 45 in the radial direction of the shaft 42. The second plate 46D extends along the outer surface of the cover member 45 in the predetermined direction.

The third plate 46E is positioned away from the first plate 46C in the predetermined direction, and extends in the radial direction of the shaft 42. The third plate 46E faces the bearing portion 41 in the predetermined direction. The third plate 46E is continuous to the other end portion of the second plate 46D, and is continuous to the second end portion 46B.

7.5 Function and Effect in Second Embodiment

In the developing cartridge 40 according to the second embodiment, the gear cover 44 includes the electrically conductive member 46, which is a metal plate. The electrically conductive member 46 includes the first end portion 46A positioned on the outer peripheral surface of the shaft 42 and the second end portion 46B in contact with the second protruding portion 8 of the shaft part 2A.

With this structure, electric power supplied to the first end portion 46A of the electrically conductive member 46 can be supplied to the shaft part 2A. The electrically conductive member 46 can be supported by the gear cover 44.

7.6 Modification to Second Embodiment

According to the second embodiment, the electrically conductive member 46 is the metal plate. However, a metal coil is also available as the electrically conductive member 46.

8. Third Embodiment

Figure 7:
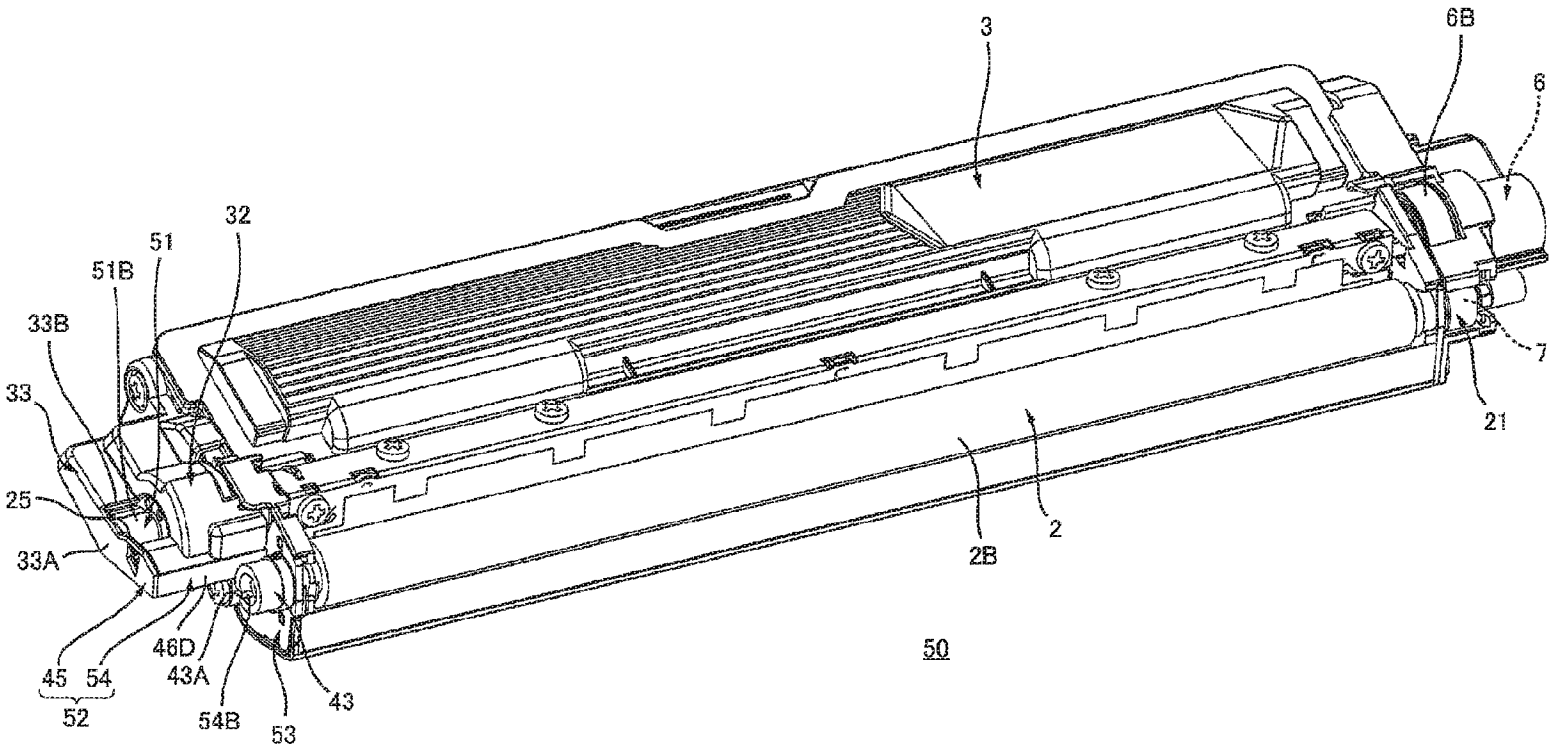
FIG. 7 is a perspective view of a developing cartridge according to a third embodiment.
Figure 8:
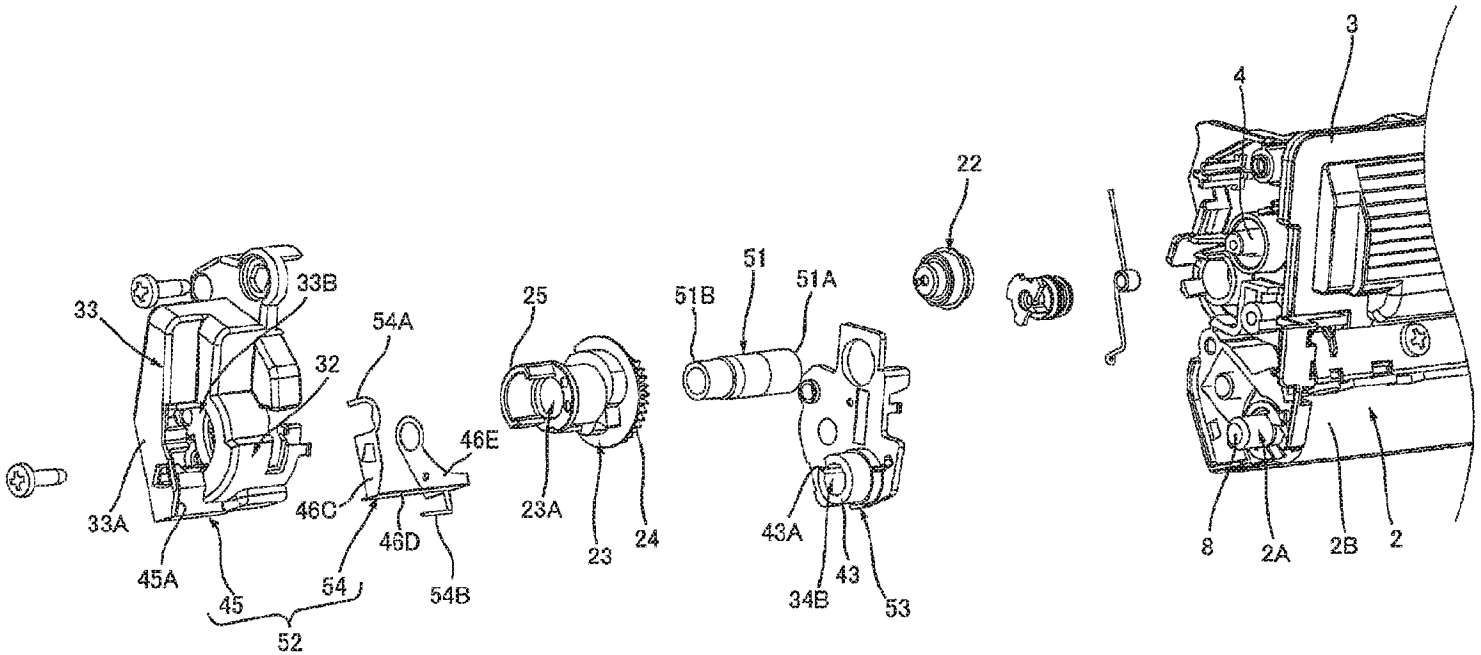
FIG. 8 is an exploded perspective view of the developing cartridge illustrated in FIG. 7.

A developing cartridge 50 according to a third embodiment will next be described with reference to FIGS. 7 and 8, wherein like parts and components are designated by the same reference numerals as those shown in the second embodiment to avoid duplicating description.

8.1 Overview of Developing Cartridge 50

In the developing cartridge 50, a shaft 51 is made from an electrically conductive resin. The shaft 51 is provided separately from the cover member 45 of a gear cover 52 and a bearing portion 53. The bearing portion 53 is the same as the bearing portion 41 of the second embodiment except that the bearing portion 53 is not provided with the shaft 42.

8.2 Shaft 51

The shaft 51 extends in the predetermined direction and includes one end portion 51A and the other end portion 51B in the predetermined direction. The one end portion 51A is mounted to the outer surface of the casing 3, and the other end portion 51B is mounted to the distal end portion 33A of the cover member 45. The other end portion 51B is positioned at the opening 33B of the cover member 45 so that the other end portion 51B is exposed to the outside through the opening 33B. The other end portion 51B has an outer peripheral surface in contact with the electrode of the image forming apparatus when the developing cartridge 50 is attached to the image forming apparatus. That is, the shaft 51 includes an electric contact.

8.3 Gear Cover 52

The gear cover 52 includes the cover member 45 which is the same as the cover member of the second embodiment, and an electrically conductive member 54.

The electrically conductive member 54 is positioned between the distal end portion 33A of the cover member 45 and the bearing portion 53 in the predetermined direction. The electrically conductive member 54 is supported to the cover member 45. The electrically conductive member 54 is a metal plate, and has a first end portion 54A and a second end portion 54B.

The first end portion 54A is positioned between an end face of the other end portion 51B of the shaft 51 and the distal end portion 33A of the cover member 45 in the predetermined direction. The first end portion 54A has an arcuate shape curved along an edge of the other end portion 51B. The first end portion 54A is in contact with the end face of the other end portion 51B of the shaft 51.

The second end portion 54B has a structure the same as that of the second end portion 46B of the electrically conductive member 46 of the second embodiment. The second end portion 54B is positioned in the slot 43A of the bearing portion 53. The second end portion 54B is in contact with the second protruding portion 8 of the shaft part 2A. Thus, the electrically conductive member 54 is electrically connected to the shaft part 2A.

8.4 Function and Effect in Third Embodiment

In the developing cartridge 50 according to the third embodiment, the gear cover 52 includes the electrically conductive member 54, which is a metal plate. The electrically conductive member 54 includes the first end portion 54A in contact with the end face of the shaft 51 and the second end portion 54B in contact with the second protruding portion 8 of the shaft part 2A.

With this structure, electric power supplied to the peripheral surface of the shaft 51 can be supplied to the shaft part 2A through the electrically conductive member 54. The electrically conductive member 54 can be supported to the gear cover 52.

8.5 Modification to Third Embodiment

Similar to the modification to the second embodiment, the electrically conductive member 54 may be the metal coil.

Further, the cover member 45 may be made from the electrically conductive resin. In the latter case, the shaft 51 may be in contact with the cover member 45 for electrical connection to the cover member 45. That is, the first end portion 54A and the first plate 46C may not be provided as long as the electrically conductive member 54 permits electrical connection between the cover member 45 and the shaft part 2A.

9. Other Modifications (1) According to the above-described first embodiment, the shaft 11 is integral with the gear cover 31. However, the shaft may be provided by a first portion extending from the gear cover 31 and a second portion extending from the casing 3 and connected to the first portion. In the latter case, the gear cover 31 may be integral with the first portion of the shaft. That is, the first portion of the shaft may be made from the electrically conductive resin. Alternatively, the first portion of the shaft may include an electric contact.

(2) Further, in the above-described embodiment, the protrusion 25 is integral with the detection gear 23. However, the protrusion 25 may be provided separately from the detection gear 23 as long as the protrusion 25 is rotatable together with the detection gear 23. For example, a protrusion may be formed separately from the detection gear 23, and may be mounted to the detection gear 23.

(3) Further, in the above-described embodiment, the detection gear 23 includes a single protrusion 25 extending in the rotational direction of the detection gear 23. Changes and modifications to the shape or the number of the detection gear 23 may be made according to the specification of the developing cartridge. For example, the detection gear 23 may include a first protrusion and a second protrusion. The second protrusion may be provided at a position away from the first protrusion in the rotational direction. Further, the first and second protrusions may be formed separately from the detection gear 23, and may be mounted to the detection gear 23.

(4) Further, the gear cover 31 may be made from the electrically conductive material. In this case, a portion other than the electric contact 11C may be masked by an electrically insulating sheet.

While the description has been made in detail with reference to specific embodiments, it would be apparent to those skilled in the art that various changes and modifications may be made therein without departing from the spirit and scope of the present disclosure.

What is claimed is:

1. A developing cartridge comprising:

a developing roller rotatable about a first axis extending in a predetermined direction and including a developing roller shaft extending along the first axis;

a shaft extending in the predetermined direction and having a peripheral surface;

a gear rotatable about the shaft;

an electric contact positioned at the peripheral surface of the shaft; and a gear cover covering at least a portion of the gear, the gear cover electrically connecting the electric contact and the developing roller shaft.

2. The developing cartridge according to claim 1, further comprising a casing configured to accommodate developing agent, wherein the shaft is positioned at an outer surface of the casing and includes one end portion and another end portion in the predetermined direction, the other end portion being spaced away from the one end portion in the predetermined direction, the other end portion being positioned farther from the outer surface of the casing than the one end portion from the outer surface of the casing in the predetermined direction, and wherein the electric contact is positioned at the other end portion.

3. The developing cartridge according to claim 1, wherein the shaft includes the gear cover.

4. The developing cartridge according to claim 1, wherein the shaft is mounted to the gear cover.

5. The developing cartridge according to claim 1, further comprising a casing configured to accommodate developing agent, wherein the shaft includes:

a first portion extending from the gear cover; and a second portion extending from the casing and connected to the first portion.

6. The developing cartridge according to claim 3, wherein the shaft includes the electric contact, and wherein the gear cover is made from electrically conductive resin.

7. The developing cartridge according to claim 4, wherein the shaft includes the electric contact and the shaft is made from electrically conductive resin, and wherein the gear cover is made from electrically conductive resin.

8. The developing cartridge according to claim 1, wherein the gear cover includes an electric conductive member, the electric conductive member being electrically connected to the developing roller shaft.

9. The developing cartridge according to claim 8, wherein the electric conductive member is a metal plate.

10. The developing cartridge according to claim 9, wherein the metal plate includes:

a first end portion including the electric contact; and a second end portion in contact with the developing roller shaft.

11. The developing cartridge according to claim 9, wherein the metal plate includes:

a first end portion in contact with the electric contact; and a second end portion in contact with the developing roller shaft.

12. The developing cartridge according to claim 1, wherein the gear includes a plurality of gear teeth, the plurality of gear teeth being arranged on a portion of a peripheral surface of the gear in a rotational direction of the gear.

13. The developing cartridge according to claim 12, further comprising:

a casing configured to accommodate developing agent;

an agitator configured to agitate the developing agent, the agitator being rotatable about a second axis extending in the predetermined direction; and an agitator gear mounted to the agitator and rotatable together with the agitator, the agitator gear engaging with at least one of the plurality of gear teeth.

14. The developing cartridge according to claim 1, further comprising a protrusion extending in the predetermined direction and rotatable together with the gear.

15. The developing cartridge according to claim 14, wherein the gear includes the protrusion.

* * * * *